US005437085A

United States Patent [19]

Liu

[11] Patent Number: 5,437,085

[45] Date of Patent: Aug. 1, 1995

[54] HAND PORTABLE RIVETER

[76] Inventor: Yang-Ting Liu, No. 76-1, 4 Lin, Shang-Guan Li, Yuan-Li, Miao-Li Hsien,

[21] Appl. No.: 152,743

[22] Filed: Nov. 16, 1993

[51] Int. Cl.[6] ..... B21J 15/34

[52] U.S. Cl. ..... 29/243.521; 29/243.53; 227/55

[58] Field of Search ..... 227/53, 55, 51, 60; 29/243.53, 243.54, 243.521, 243.527, 243.528; 72/453.17, 391.4, 391.6

[56] References Cited

U.S. PATENT DOCUMENTS

| | | | |
|---|---|---|---|
| 553,284 | 1/1896 | Jaberg | 227/55 |
| 637,489 | 11/1899 | Thompson | 227/55 |
| 3,250,450 | 5/1966 | Le Page et al. | 227/60 |
| 4,353,239 | 10/1982 | Fujimoto | 29/243.528 |
| 4,807,460 | 2/1989 | Tzong | 29/243,528 |

FOREIGN PATENT DOCUMENTS

| | | | |
|---|---|---|---|
| 1085076 | 1/1955 | France | 227/55 |
| 0405664 | 11/1924 | Germany | 227/55 |
| 2264780 | 7/1975 | Germany | 29/243.521 |
| 0021015 | 5/1912 | United Kingdom | 227/60 |

*Primary Examiner*—Jones: Eugenia
*Assistant Examiner*—Allan M. Schrock
*Attorney, Agent, or Firm*—Morton J. Rosenberg; David I. Klein

[57] ABSTRACT

A hand portable riveter includes a handle pivoted to a casing to move a pull shaft through a transmission mechanism, causing it to set a rivet or rivnut via a riveter tip assembly, wherein the transmission mechanism consists of a pressure bar pivoted about a pivot in the middle and having a front fork stopped around a neck portion on the pull shaft and a rear fork, and a roller mounted on the rear fork by a pin; turning the handle in one direction causes the pressure bar to press the pull shaft downwards; turning the handle in the reversed direction causes the roller turned along the casing to give a pressure to the pressure bar in lifting the pull shaft.

1 Claim, 6 Drawing Sheets

HAND PORTABLE RIVETER

BACKGROUND OF THE INVENTION

1. Field of the Invention

The present invention relates to riveters, and more specifically relates to a hand portable riveter which is suitable for setting rivets as well as rivnuts.

2. Prior Art

Prior art riveters are known and are commercially available. Two prior art riveters are shown in FIGS. 4 and 5 which are designed for setting rivets or rivnuts. As conventional riveters are specifically designed for a specific purpose, a single riveter cannot be used for setting both rivets and rivnuts. Therefore, different riveters must be made available when both rivets and rivnuts are to be set.

SUMMARY OF THE INVENTION

The present invention has been provided to allow use of a single riveter for use with both rivets and rivnuts. It is therefore the principal object of the present invention to provide a riveter which is practical for setting rivets as well as rivnuts. It is another object of the present invention to provide a dual-usage riveter which is hand portable.

According to the preferred embodiment of the present invention, the hand portable riveter comprises a handle pivoted to a casing to linearly move or displace a pull shaft through actuation of a transmission mechanism which causes the pull shaft to set a rivet or rivnut via a riveter tip assembly. The transmission mechanism consists of a pressure bar pivoted about a second pivot point located centrally in the pressure bar extension. The pressure bar has a front fork section surrounding a neck portion formed on the pull shaft and further includes a rear fork section. A roller is mounted on the rear fork section by a roller pin. Turning the handle in one direction about a first pivot point causes the pressure bar to press the pull shaft downwards. Turning the handle in a reversed direction with respect to the first direction causes the roller to move along an arcuate surface of a handle cam member to apply pressure to the pressure bar to lift the pull shaft.

DETAILED DESCRIPTION OF THE PREFERRED EMBODIMENT

Figure 1:
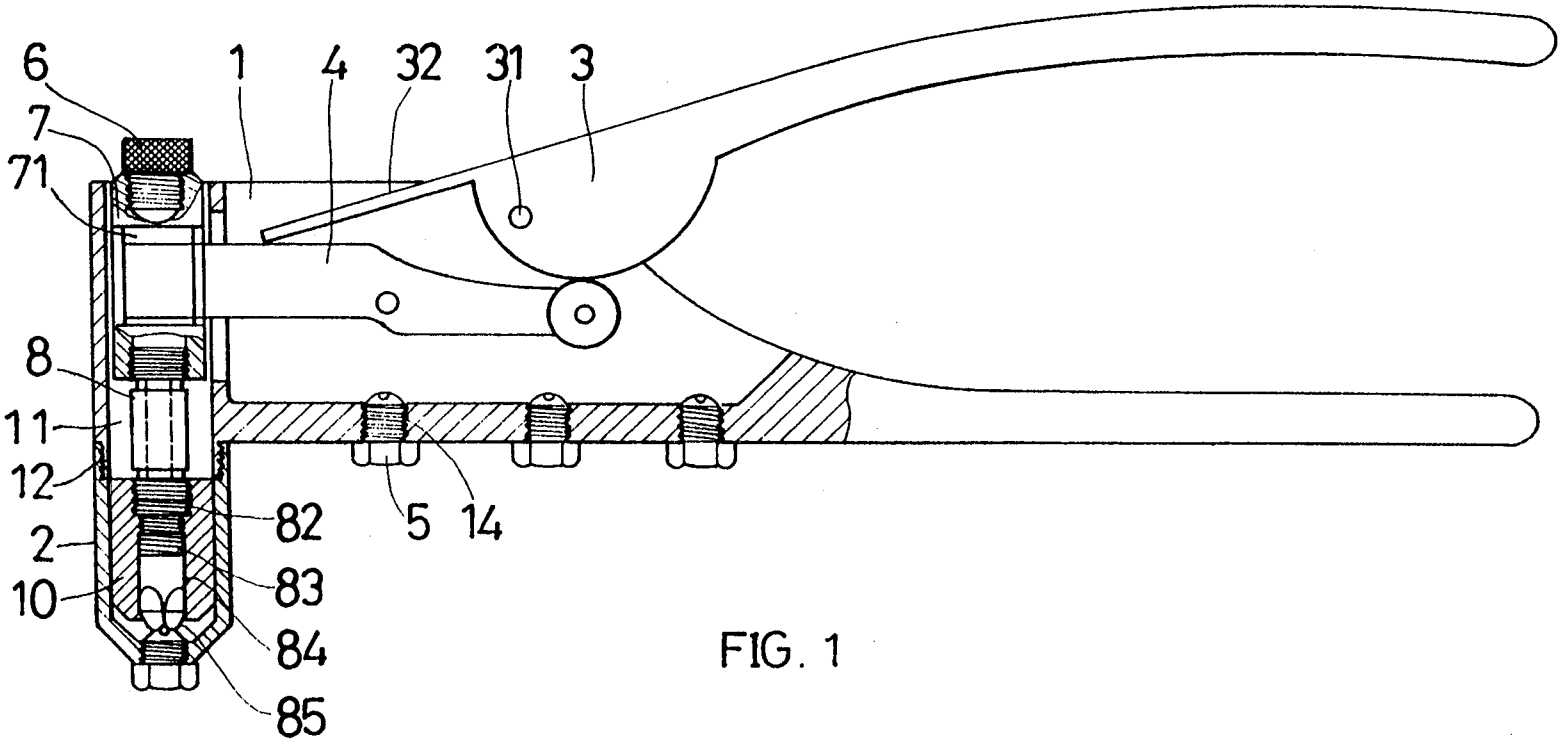
FIG. 1 is an elevational view partially in cross-section of a hand portable riveter according to the preferred embodiment of the present invention.
Figure 1A:
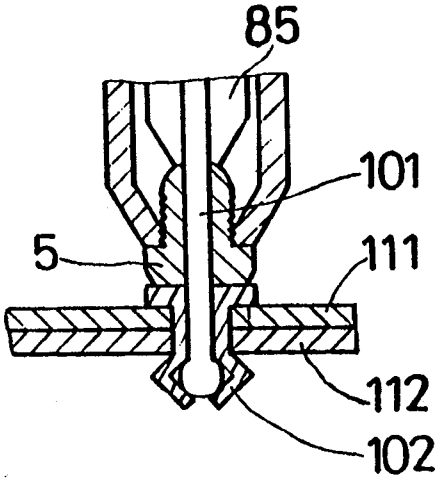
FIG. 1A is a sectional view showing a rivet deformed by the hand portable riveter of FIG. 1 to fasten two workpieces together.
Figure 3:
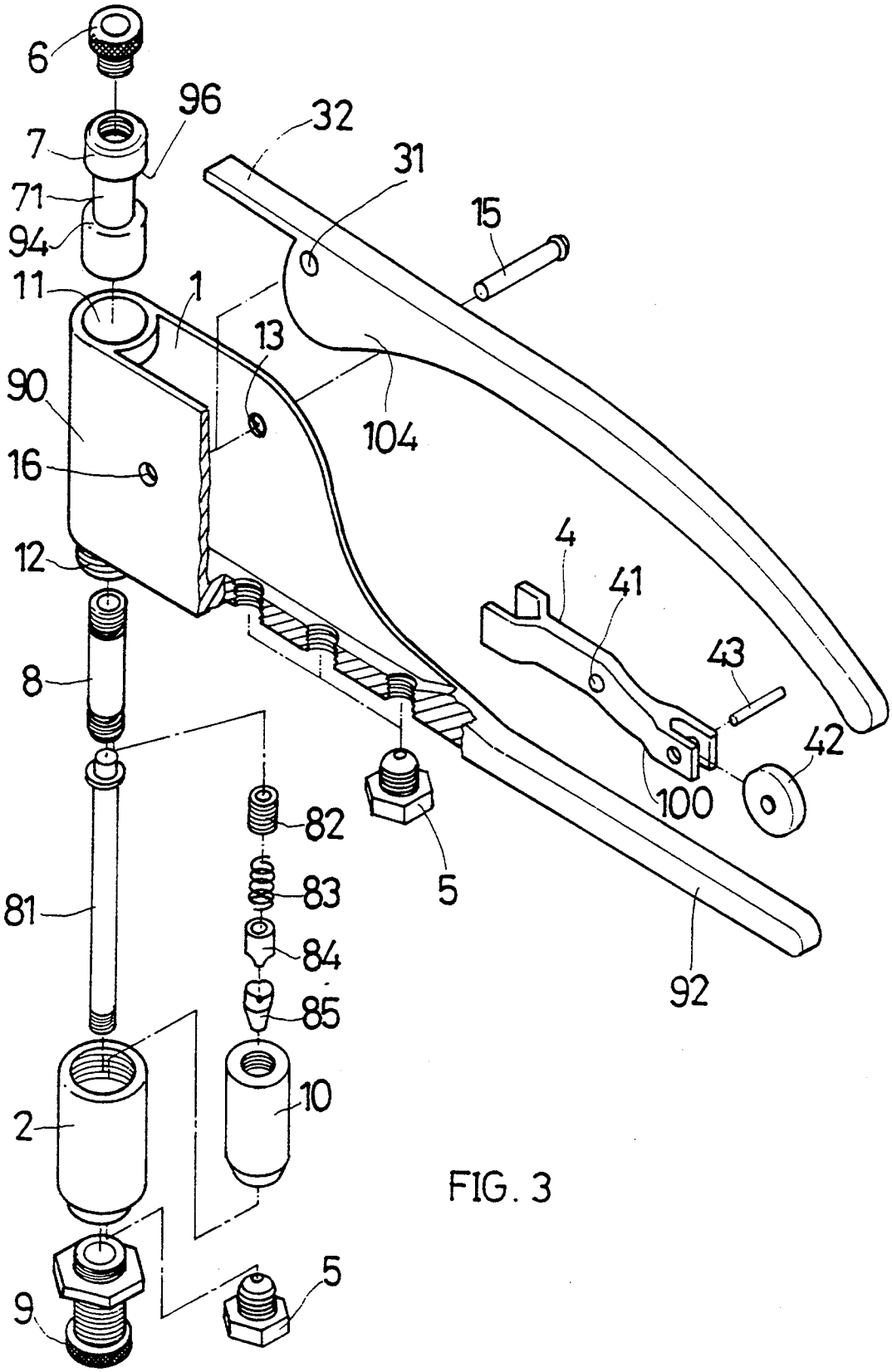
FIG. 3 is an exploded view of the hand portable riveter of FIG. 1.
Figure 4:
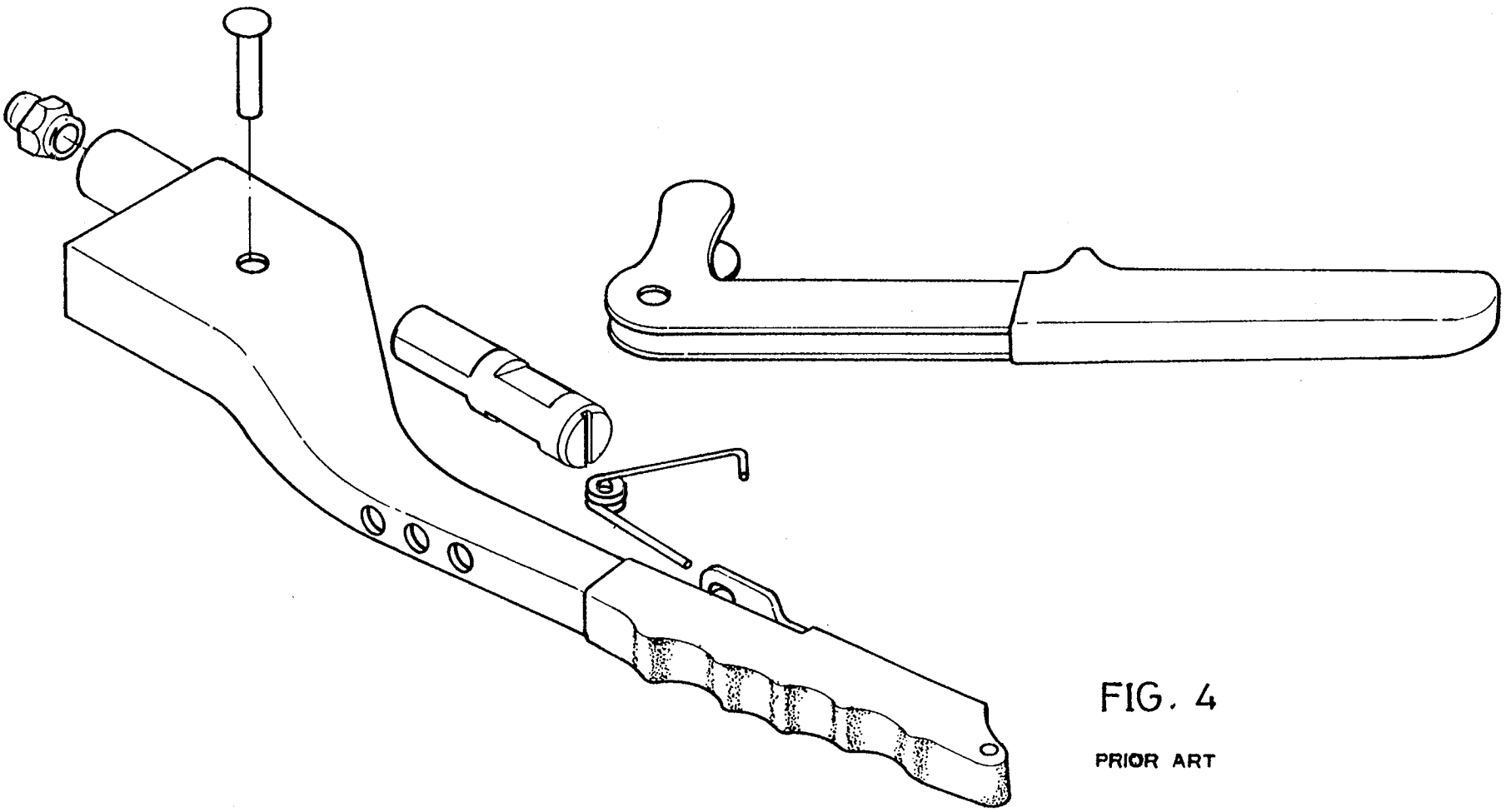
FIG. 4 PRIOR ART
FIG. 4 shows a vertical type riveter according to the prior art.
Figure 5:
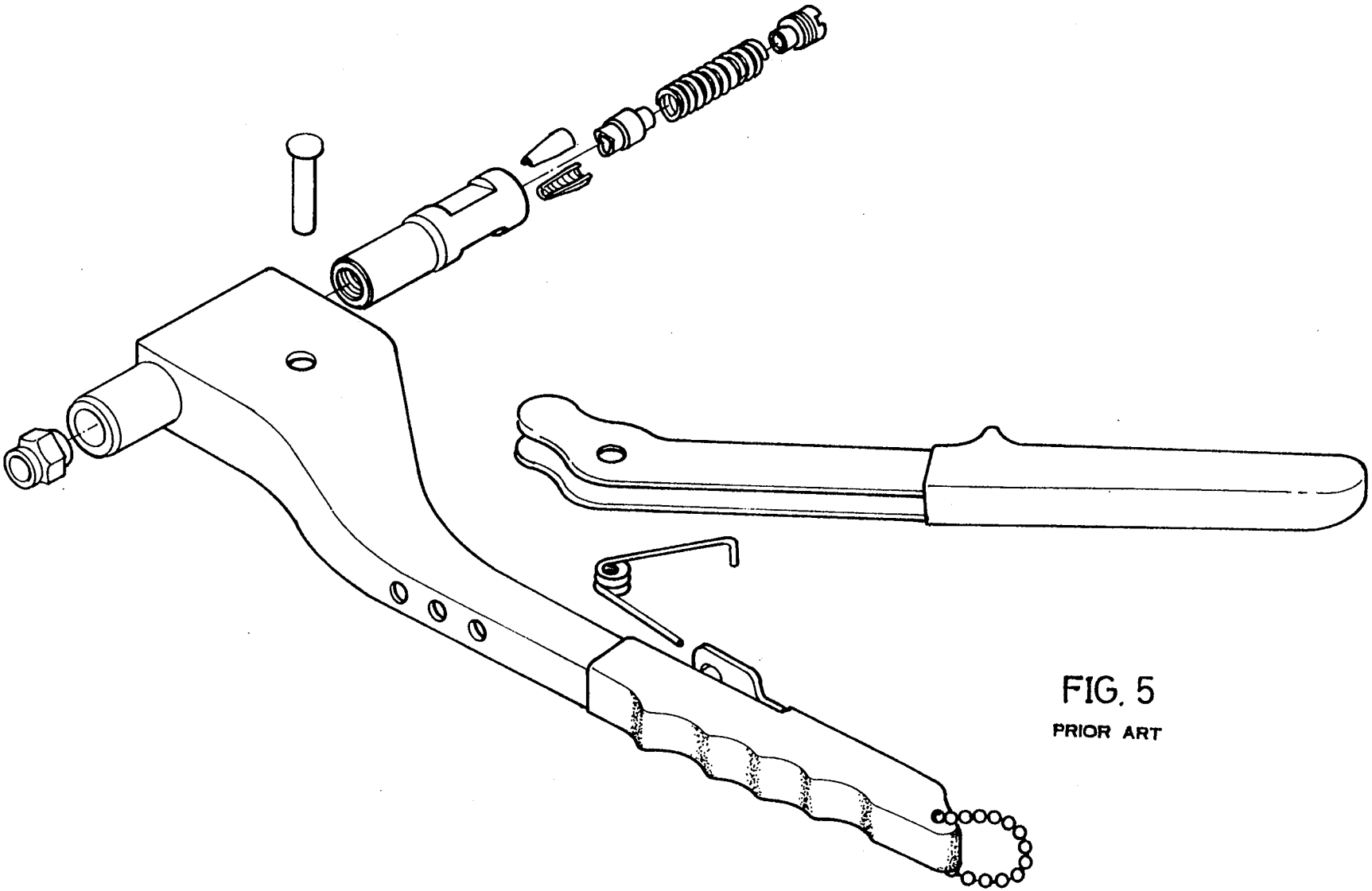
FIG. 5 PRIOR ART
FIG. 5 shows a horizontal type riveter according to the prior art.

Referring now to FIGS. 1 and 3, a riveter in accordance with the present invention in shown which comprises a casing 1 having an outer socket or front casing section 2 and a rear casing section 92, a handle 3, a pressure bar 4, a first riveter tip 5, a screw 6, a pull shaft 7, a coupling 8, a screw rod 81, a second riveter tip 9, and an inner socket 10.

The casing 1 includes a through tool hole 11 vertically disposed on one end thereof, an outer thread 12 is formed around the front casing section 2 at a bottom section thereof. A pair of pivot holes 13 are transversely aligned to each other in the middle of the casing 1. Two pin holes 16 are transversely aligned between the tool hole 11 and the pivot holes 13, and a plurality of screw holes 14 are formed in the casing 1 lower portion as shown. The pull shaft 7 is slidingly received within the tool hole 11 of the casing 1, having a neck portion 71 in the middle defining a lower shoulder 94 and an upper shoulder 96. The screw 6 is threadedly connected to the pull shaft 7 at a top portion thereof forming a threaded joint. A coupling 8 is received in the tool hole 11 and has a top end connected to the pull shaft 7 at the pull shaft bottom section through a threaded joint connection. The pressure bar 4 has a pin hole 41 defining a second pivot point connected between the pin holes 16 within the casing 1 by a pivot pin 15. The front end of the pressure bar 4 is forked defining a front forked section 98 and inserted into the tool hole 11 and mounted around the neck portion 71 of the pull shaft 7. The rear end of the pressure bar 4 is forked defining a rear forked section 100 coupled with a roller 42 by a pin 43. The handle 3 comprises a pivot hole 31 connected between the pivot holes 13 within the casing 1 by a pivot pin (not shown) defining a first pivot point. A front extension 32 extends to a point above the front end of the pressure bar 4 as is shown. The outer socket 2 is decreasingly tapered toward the bottom section and has an inner thread 12 formed on a top end thereof threaded onto the outer thread 12 on the casing 1.

Different elements may be disposed within the outer socket 2 according to the purpose of the riveter for setting rivets or rivnuts. When the riveter is used for setting a rivet, as shown in FIGS. 1 and 1—1, two symmetrical clamping plates 85 are inserted into the inner socket 10 to support a rod 84, a spring 83, and a stop member 82 in cooperating relationship permitting the stop member 82 to be connected to the bottom end of the coupling 8 through a threaded joint for coupling to the first riveter tip 5.

Referring again to FIGS. 1, 1—1, and 3, pulling the handle 3 from the casing 1 causes the front extension 32 of the handle 3 to press against pressure bar 4, forcing the front forked section 98 against lower shoulder 94 whereby the pull shaft 7 is moved downwardly by the pressure bar 4, As the pull shaft 7 is moved downwardly, the clamping plates 85 are forced to separate from each other and a rivet rod 101 is inserted through the first riveter tip 5, and then the rivet tube 102 is inserted through the workpieces 111, 112 to be fastened. As the handle 3 is depressed, the roller 42 rolls on the handle cam member 104 arcuate surface which causes the pressure bar 4 to act against upper shoulder 96 and lift the pull shaft 7, whereby the coupling 8 is moved to carry the rivet rod 101 upwardly. As the rivet rod 101 is moved upwards, the rivet tube 102 is deformed and the workpieces 111, 112 are tightly fastened together when the rivet rod 101 is broken.

Figure 2A:
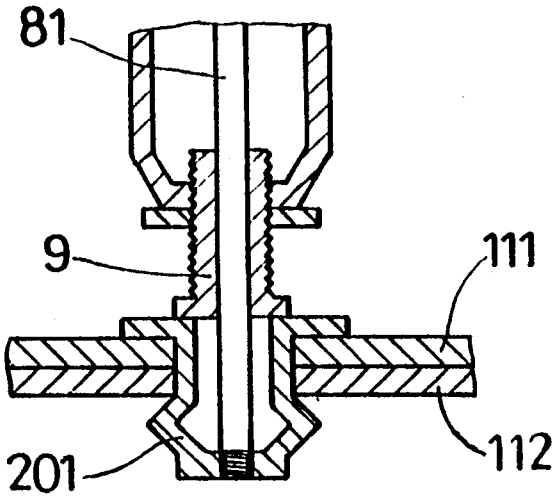
FIG. 2A is a sectional view showing a rivnut deformed by the hand portable riveter of FIG. 2 to fasten two workpieces together.
Figure 2:
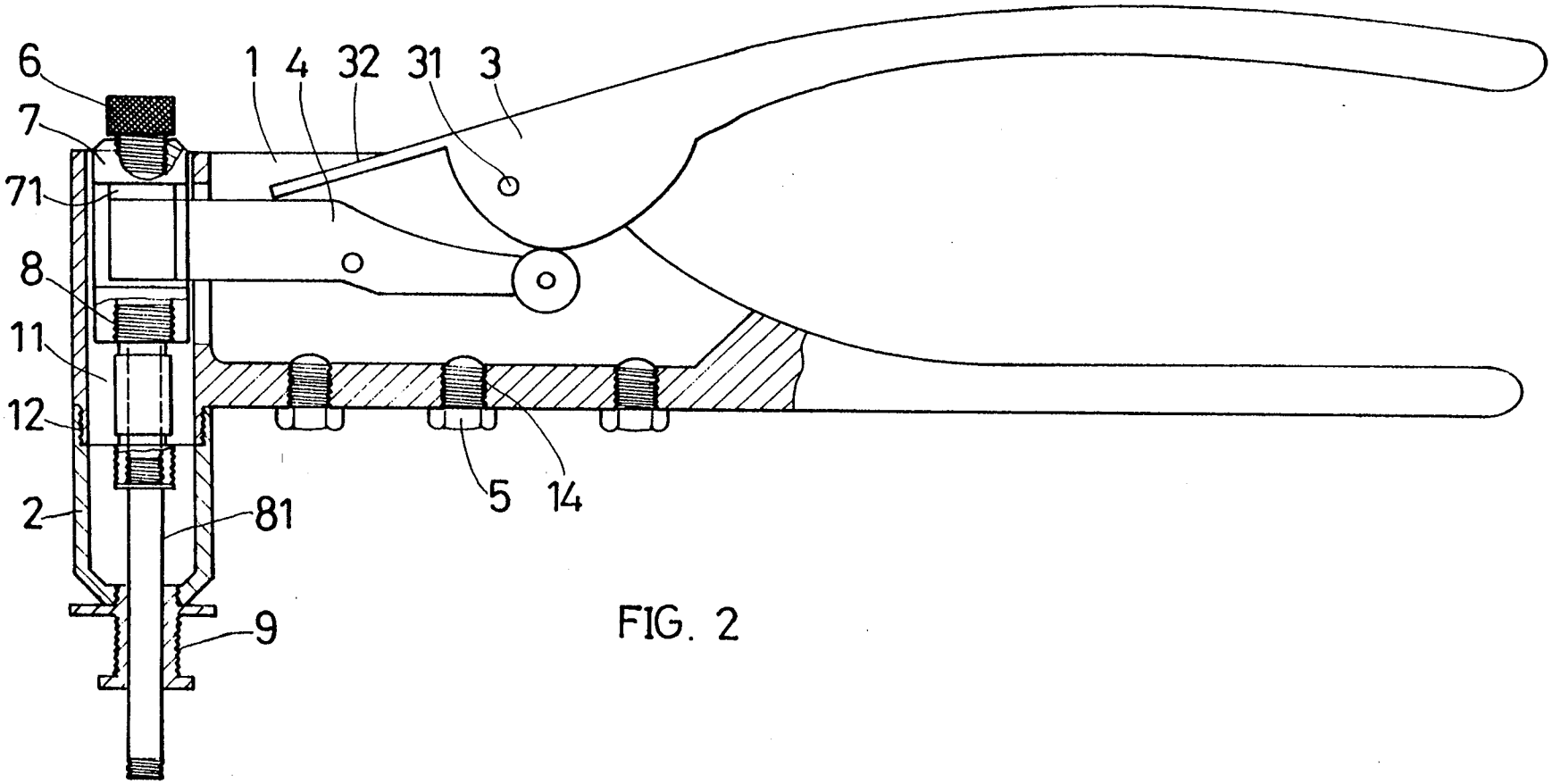
FIG. 2 is an elevational view partially in cross-section of the hand portable riveter of FIG. 1 arranged for setting a rivnut.

When the riveter is used for setting a rivnut, as shown in FIGS. 2, 2-1, and 3, the screw rod 81 is connected to the coupling 8 and the outer socket 2 is threaded onto the outer thread 12 on the casing 1. The second riveter tip 9 is fastened to the outer socket 2 at the bottom section thereof. When assembled, the screw rod 81 extends out of the second riveter tip 9.

Referring again to FIGS. 2, 2-1, and 3, the handle 3 is lifted from the casing 1 to move the pull shaft 7 downwardly via the pressure bar 4, so as to permit extension of the screw rod 81 out of the outer socket 2. The rivnut 201 is then threaded onto the pull rod 81 at a bottom end and inserted through the workpieces 111, 112 to be fastened. As the handle 3 is depressed, the pull shaft 7 is lifted to carry the screw rod 81 upwards, and therefore the rivnut 201 is squeezed, resulting in a fastening deformation.

What is claimed is:

1. A hand manipulated portable riveter for setting a rivet or a rivnut by a riveter tip assembly, comprising:

(a) a casing having a longitudinally extending rear casing section and a front vertically extending casing section, said front casing section having a vertically extending through tool hole passing therethrough;

(b) a longitudinally extending handle member having a front extension member and an integrally formed cam member having an arcuate surface depending therefrom, said handle member being pivotally coupled to said casing about a first pivot point;

(c) a pull shaft slidably displaceable in said through tool hole of said front casing section, said pull shaft having a neck portion defining an upper shoulder and a lower shoulder; and, (d) transmission means for reversibly displacing said pull shaft within said through tool hole, said transmission means including a longitudinally extending pressure bar pivoted about a central point to said casing defining a second pivot point displaced from said first pivot point, said pressure bar having a front forked section and a rear forked section, said front forked section being mounted around said pull shaft neck portion between said upper and lower shoulders for bearing against said pull shaft lower shoulder when said pressure bar is rotated about said second pivot point in a first direction and bearing against said pull shaft upper shoulder when said pressure bar is rotated about said second pivot point in a second direction opposing said first direction, a roller member rotatably mounted in said rear forked section being in rolling contact on said arcuate surface of said cam member, whereby when said handle member is rotated about said first pivot point in said first direction, said front extension member contacts an upper surface of said pressure bar for pivoting said pressure bar about said second pivot point in said first direction and contiguously locating said front forked section against said lower shoulder for displacing said pull shaft and when said handle member is rotated about said first pivot point in said second direction, said cam member contacting said roller member on said arcuate surface for pivoting said pressure bar about said second pivot point in said second direction and contiguously locating said front forked section against said upper shoulder for displacing said pull shaft.

* * * * *